US008794420B1

(12) United States Patent
Smith et al.

(10) Patent No.: US 8,794,420 B1
(45) Date of Patent: Aug. 5, 2014

(54) SECURE STORAGE APPARATUS

(71) Applicant: FKI Security Products, New Albany, IN (US)

(72) Inventors: Michael J. Smith, Scottsburg, IN (US); Daniel Jones, Elizabeth, IN (US)

(73) Assignee: Fire King Security Products, LLC, New Albany, IN (US)

( * ) Notice: Subject to any disclaimer, the term of this patent is extended or adjusted under 35 U.S.C. 154(b) by 0 days.

(21) Appl. No.: 13/752,686

(22) Filed: Jan. 29, 2013

(51) Int. Cl.
*G07F 9/10* (2006.01)

(52) U.S. Cl.
CPC ..... *G07F 9/10* (2013.01)
USPC ..... 194/350; 194/351

(58) Field of Classification Search
CPC ... E05B 67/383; E05B 83/10; E05B 65/0075; E05C 7/00; E05C 7/04; E05C 19/186; E05G 1/00; E05G 1/026; E05G 1/04; E05G 1/024; E05G 2700/00; E05D 7/14; A47B 53/00; A63F 2007/3045; G07F 1/00; G07F 9/06; G07F 9/10
USPC ..... 194/350, 351, 353; 70/DIG. 65; 109/73, 109/74
See application file for complete search history.

(56) References Cited

U.S. PATENT DOCUMENTS 3,735,714 A * 5/1973 Shoop ..... 109/59 R
4,669,394 A * 6/1987 Fogleman et al. ..... 109/59 T
5,438,855 A 8/1995 Ikeda
5,544,728 A 8/1996 Dabrowski
5,740,897 A 4/1998 Gauselmann
5,742,034 A 4/1998 Meeker
5,836,435 A 11/1998 Fujita et al.
5,883,371 A 3/1999 Meeker
5,890,439 A 4/1999 McGunn
5,896,974 A 4/1999 Chang
5,907,141 A 5/1999 Deaville et al.
5,967,287 A 10/1999 Cole
6,047,998 A * 4/2000 Pollard et al. ..... 292/1
6,067,530 A 5/2000 Brooks, Jr. et al.
6,276,603 B1 8/2001 Patterson
7,850,076 B1 * 12/2010 Dorenbaum ..... 235/381
8,438,885 B2 * 5/2013 Calder ..... 70/78
8,443,737 B2 * 5/2013 Todd ..... 109/59 R
2002/0007771 A1 * 1/2002 Braddock ..... 109/47
2002/0100399 A1 8/2002 Young
2002/0108310 A1 * 8/2002 Schroer ..... 49/280
2004/0050650 A1 3/2004 Yamagishi
2005/0040005 A1 2/2005 Dobbins
2005/0104381 A1 * 5/2005 Whitaker et al. ..... 292/190
2006/0021848 A1 * 2/2006 Smith ..... 194/350
2006/0152339 A1 * 7/2006 Mercier et al. ..... 340/5.73
2009/0056599 A1 * 3/2009 Turner et al. ..... 109/2
2009/0166152 A1 * 7/2009 Dobbins ..... 194/350
2010/0242810 A1 * 9/2010 Todd ..... 109/59 R
2010/0307205 A1 * 12/2010 Calder ..... 70/58
2011/0083591 A1 * 4/2011 Stepp ..... 109/64
2013/0082822 A1 4/2013 Levenick

* cited by examiner

*Primary Examiner* — Jeffrey Shapiro
(74) *Attorney, Agent, or Firm* — Great Lakes Intellectual Property, PLLC.

(57) ABSTRACT

An apparatus, such as but not necessarily limited to a safe, is contemplated. The apparatus may be configured to secure a sorter, bill validator or other delivery mechanism separately from a storage area in order to permit removal of the delivery mechanism without compromising security of the storage area.

19 Claims, 6 Drawing Sheets

SECURE STORAGE APPARATUS

TECHNICAL FIELD

The present invention relates to secure storage apparatuses, such as but not necessarily limited to safes, vending machines and video gaming machines.

BACKGROUND

As described in U.S. Pat. No. 8,348,043, the disclosure of which is hereby incorporated by reference in its entirety, a sorter, bill validator or other delivery mechanism may be configured to facilitate processing and delivering deposits to a storage area for safekeeping. The deposits inputted to the sorter may include dirt, grease, tape, and any variety of other particulate debris. The electro-mechanical nature of the sorter and the debris carried by the deposits may render the validator susceptible to service interruptions. Periodic servicing of the validator may be needed to clean out such debris and/or to service or replace malfunctioning or overused components. Accordingly, a need exists to facilitate servicing the sorter without compromising the security of items kept within the storage area.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
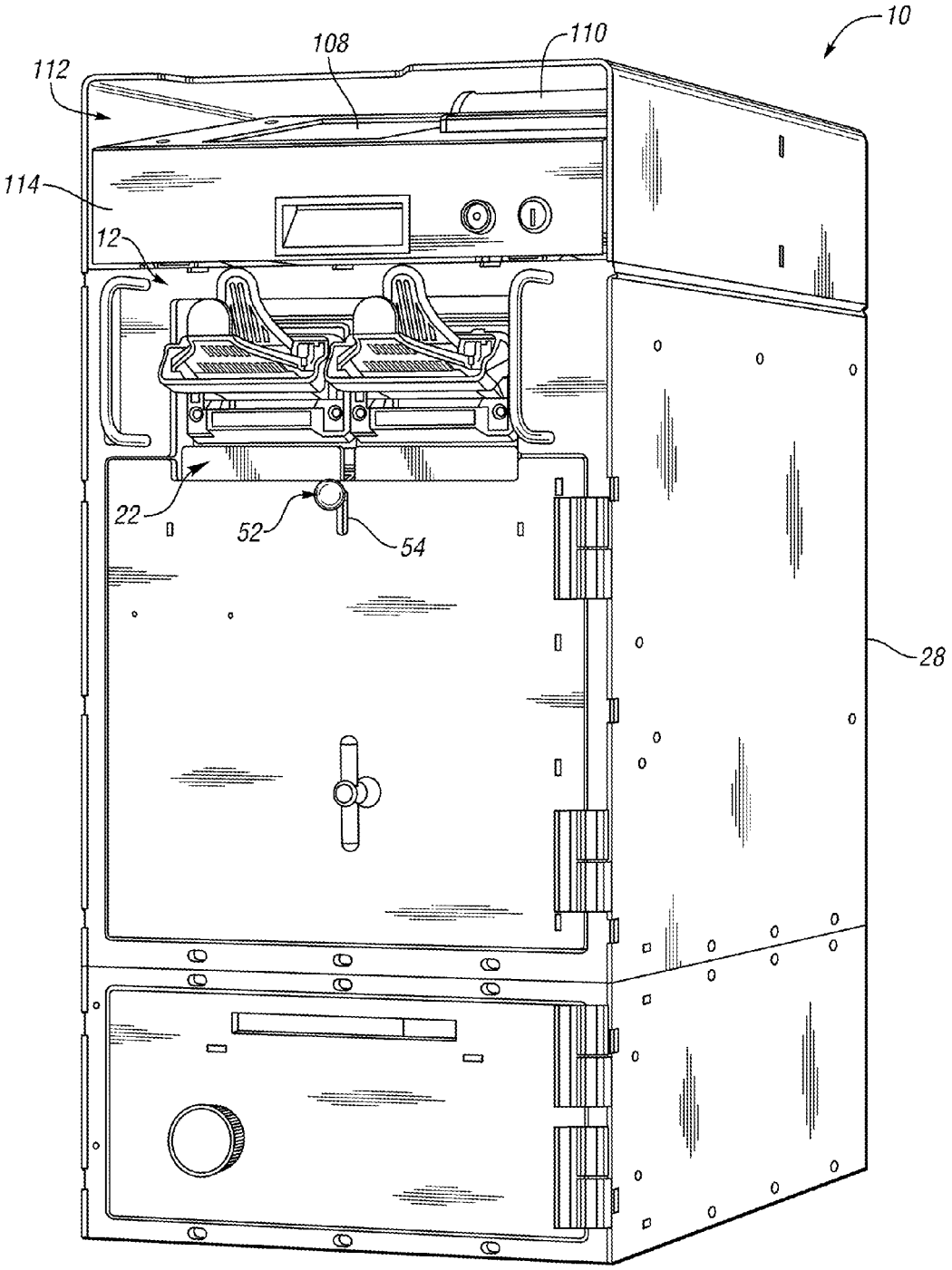
FIG. 1 illustrates a secure storage apparatus in accordance with non-limiting aspect of the present invention.
Figure 2:
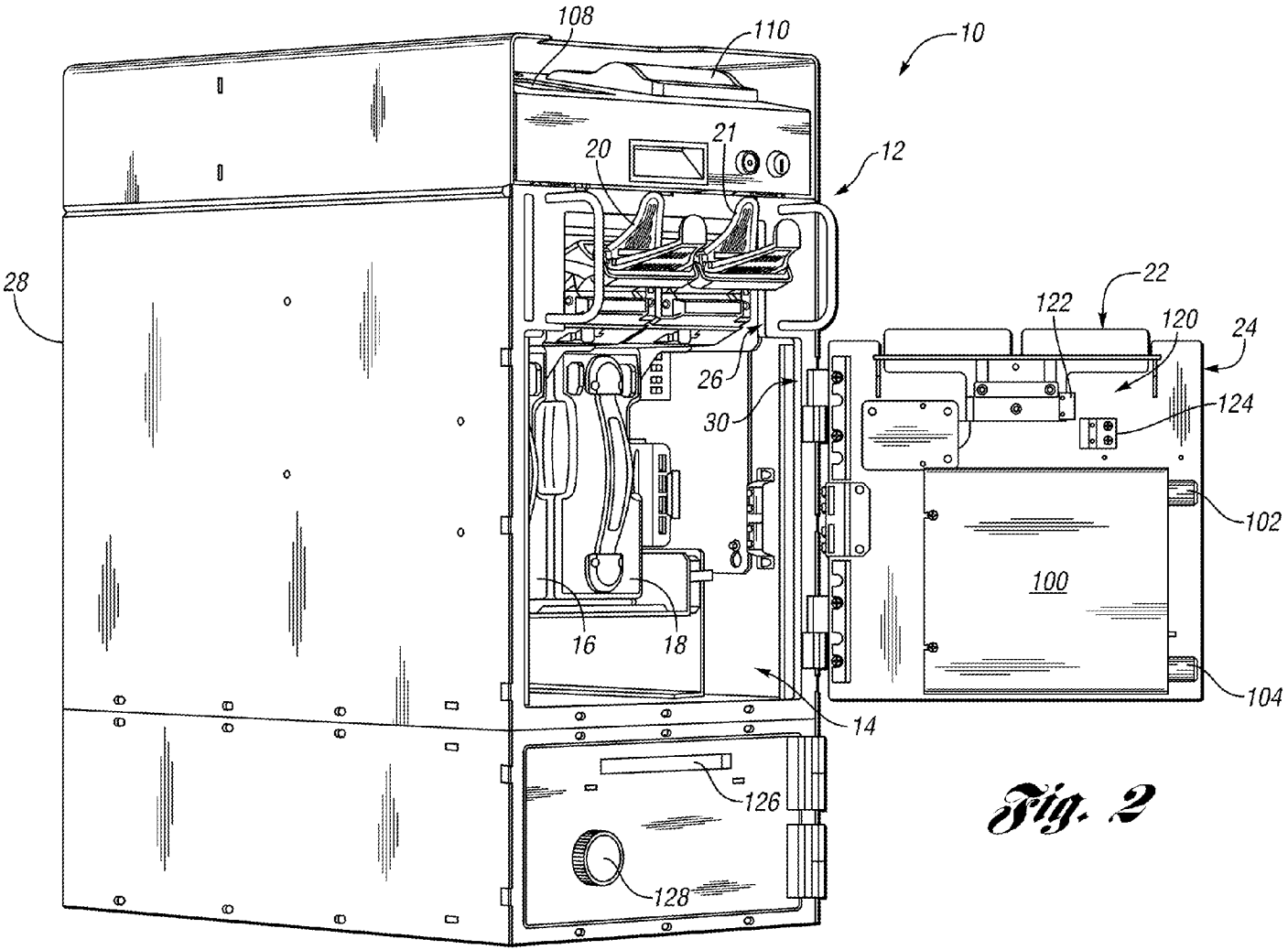
FIG. 2 illustrates an interior view of the secure storage apparatus as contemplated by one non-limiting aspect of the present invention.

FIG. 1 illustrates a secure storage apparatus 10 in accordance with non-limiting aspect of the present invention. The secure storage apparatus 10 may be configured to facilitate safekeeping of deposits, such as but not necessarily limited to deposits in the form of coins, paper currency, bills, documents, letters, boxes or other items that may be electro-mechanically delivered through an exterior input for safekeeping within an interior storage location. The secure storage apparatus 10 is predominately described with respect to being configured as a safe having a sorter 12 configured as a bill validator operable to receive and process paper currency for safekeeping. FIG. 2 illustrates an interior storage location 14 of the secure storage apparatus 10 as contemplated by one non-limiting aspect of the present invention. The interior storage location 14 is shown to include a first cassette 16 and a second cassette 18 operable with a first head 20 and a second head 21 of the bill validator 12 to facilitate processing and safe storage of paper currency. The secure storage apparatus 10 may be configured to facilitate servicing of the bill validator 12 while maintaining security of the currency kept within the first and second storage cassettes 16, 18.

Figure 3:
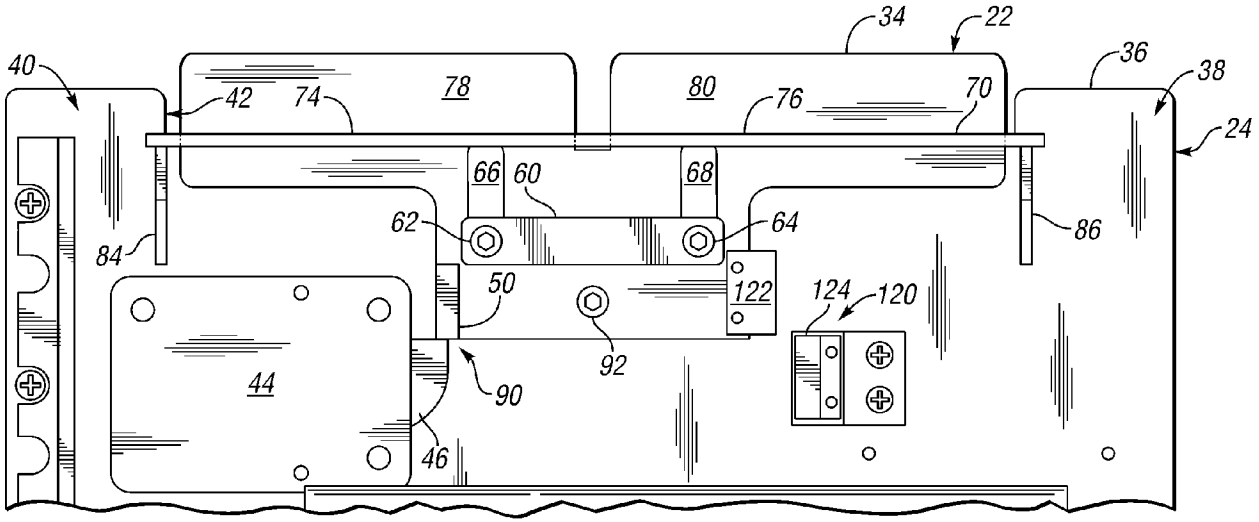
FIGS. 3-6 illustrate a shutter in a closed position in accordance with one non-limiting aspect of the present invention.
Figure 7:
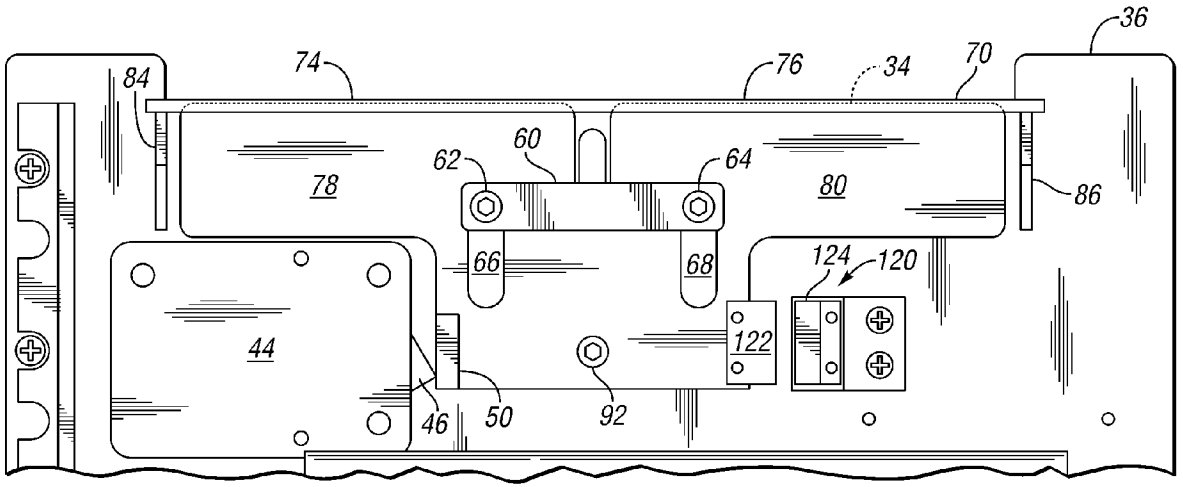
FIGS. 7-10 illustrate the shutter in an opened position in accordance with one non-limiting aspect of the present invention.
Figure 5:
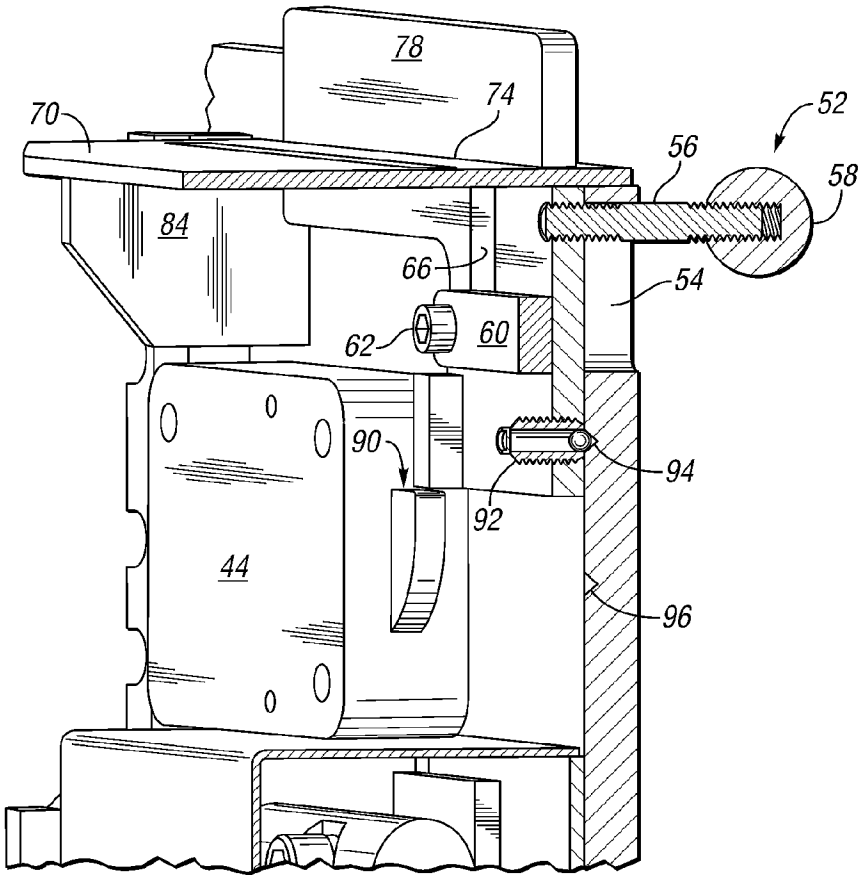
Figure 4:
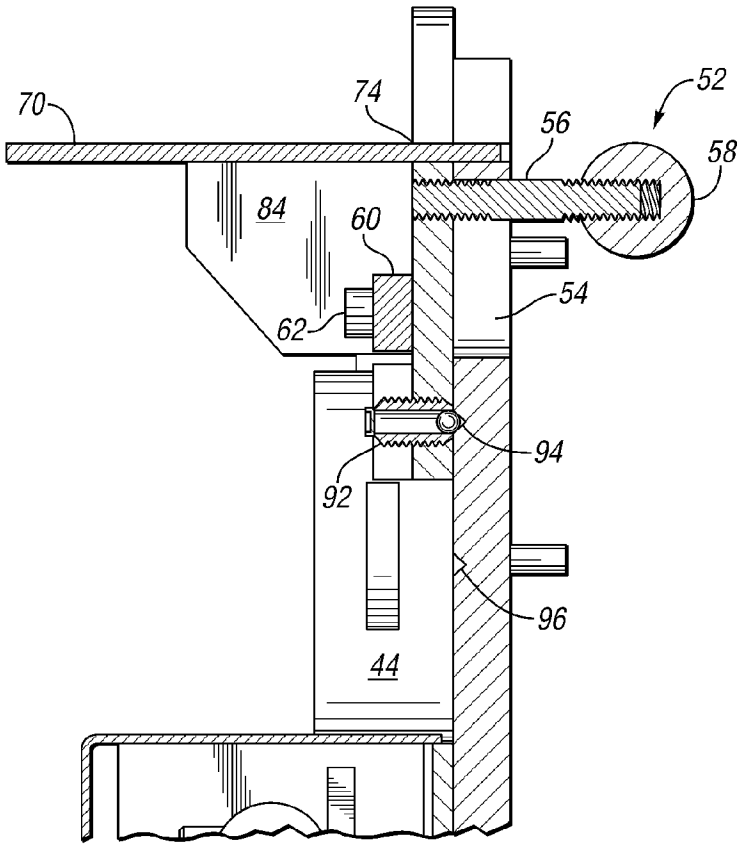
Figure 10:
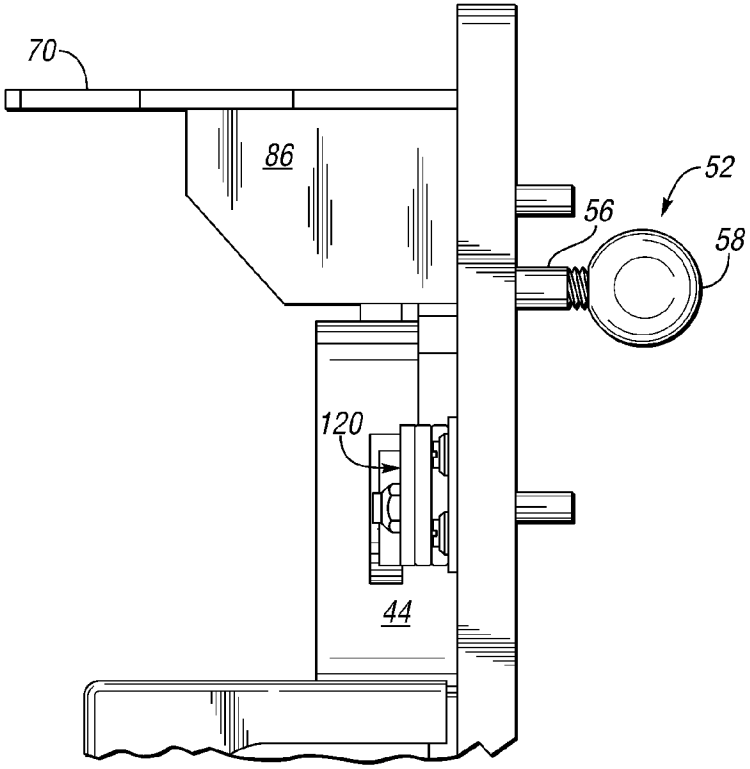
Figure 6:
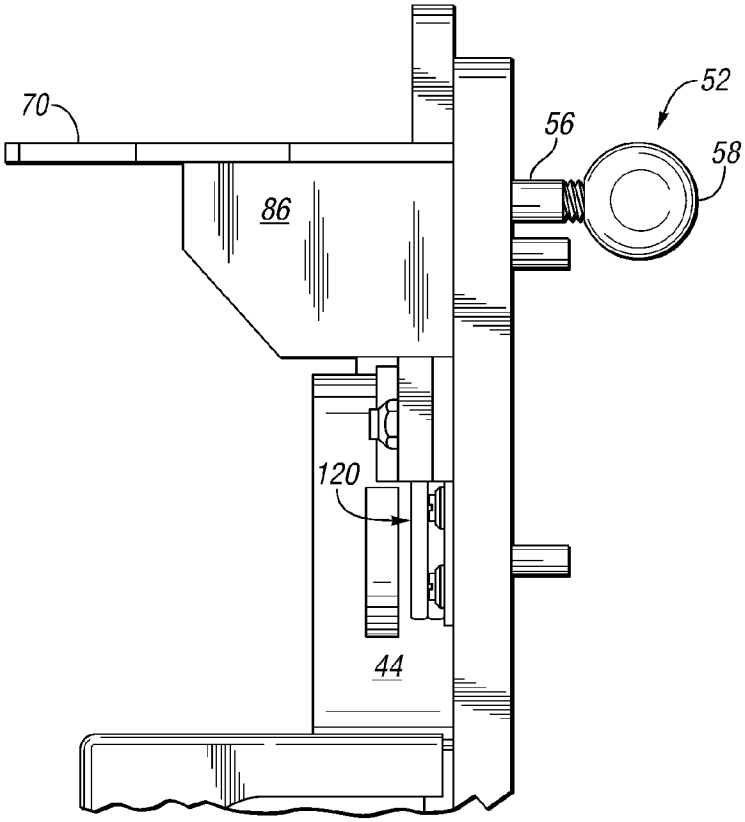
Figure 9:
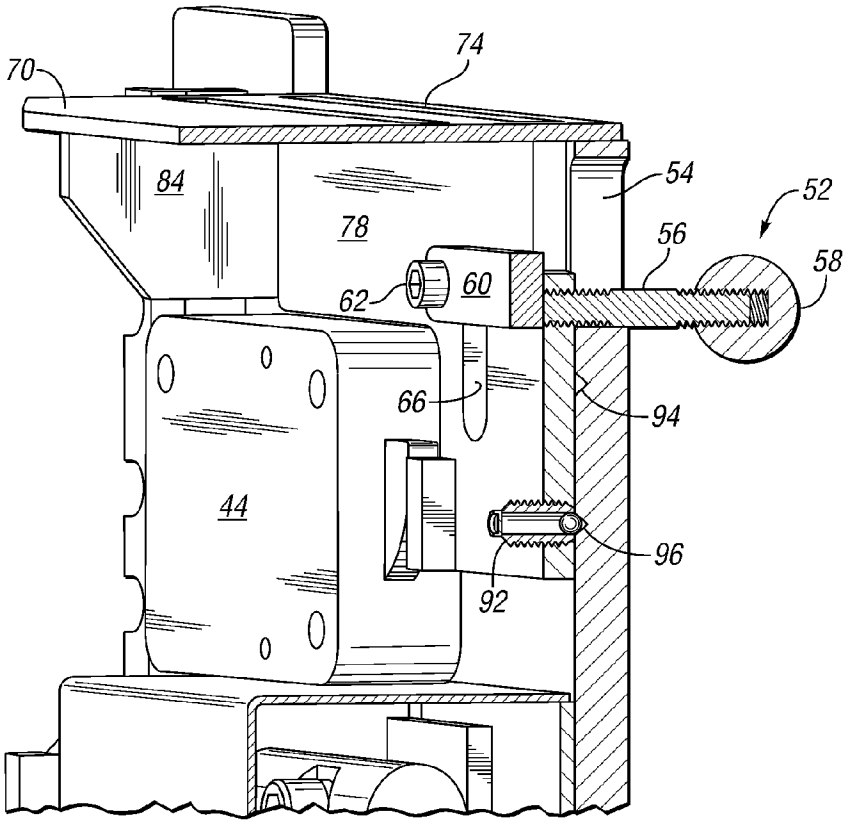
Figure 8:
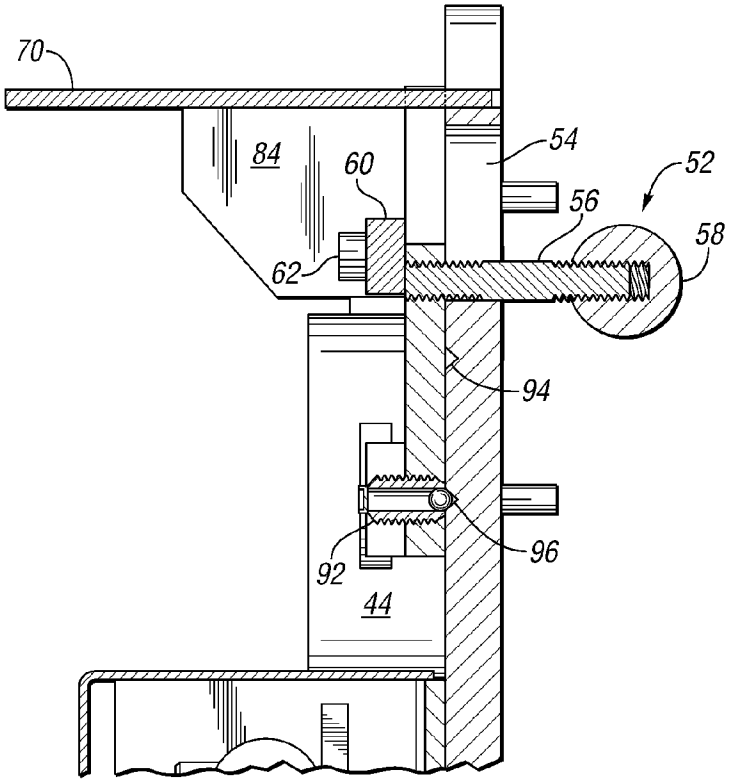

The apparatus 10 may include a shutter 22 mounted or otherwise affixed to a door 24 to permit servicing of the bill validator 12 while maintaining security of the stored items. The shutter 22 may be movable positionable relative to a first opening 26 in a substantially enclosed housing 28 forming a body of the apparatus 10. The first opening 26 may be sufficiently shaped within a side of the housing 28 to permit removal of the bill validator 12, one or more of the bill validator heads 20, 21 or other component of the validator 12, therethrough. The door 24 may be movable positioned relative to a second opening 30 in the side of the housing 28. The second opening 30 may be shaped to permit removal of the cassettes 16, 18 or other storage container configured to receive the deposit therethrough. The shutter 22 may be movable positioned between a closed position (see FIG. 3) and an opened position (see FIG. 7) to respectively prevent and permit removal of the bill validator. The door may be movable between a closed position (see FIG. 1) and an opened position (see FIG. 2) to respectively prevent and permit removal of the storage cassette 16, 18. The shutter 22 may be configured in accordance with the present invention to permit removal of the bill validator 12 while the door 24 is in the closed position, thereby enabling servicing of the bill validator 12 without compromising security of the deposited items.

FIGS. 3-6 illustrate the shutter 22 in the closed position in accordance with one non-limiting aspect of the present invention. The closed position is shown to correspond with an upper portion 34 of the shutter 22 being positioned above an upper most surface 36 of the door 24. In this position, the shutter 22 at least partially covers the first opening 26 to block or otherwise prevent removal of the bill validator 12 while the door 24 is in the closed position. The door 24 may be u-shaped near the upper most surface 36 with lateral portions 38, 40 on either side of the shutter 22 and a relief 42 therebetween. The relief 42 may be sized to approximate a width of the first opening 26, which in turn may be sized to be slightly wider than a width of the bill validator 12, such that at least a portion of the first opening 26 is defined by the relief 42 in the door 24 and sufficient to permit passage of the bill validator 12 therethrough. A shutter lock 44 operable between a locked and an unlocked state may be mounted relative to the shutter 22 to secure the shutter 22 in the closed position. The shutter lock 44 may include a swing bolt 46 or other retractable or controllably obstructing feature to block movement of the shutter 22 from the closed position to the opened position. The shutter lock 44 may be an electronically operable type of lock capable of actuating between the locked and unlocked position in response to messages and/or electronic signaling.

FIGS. 7-10 illustrate the shutter 22 in the opened position in accordance with one non-limiting aspect of the present invention. The opened position is shown to correspond with the upper portion 34 of the shutter 22 being positioned below the upper most surface 36 of the door 24 to permit removal of the bill validator 12. When in the opened position, the upper portion 34 of the shutter may be positioned below a lowest, removable portion of the bill validator 12 or the lowest portion of the bill validator 12 desired for removal/servicing. A height of the lateral sides 38, 40 may be in-line, above or below a horizontal plane associated with the lowest removable portion of the bill validator 12 (shown as above). The shutter 22 and relief 42 may be correspondingly shaped to the height of the door 24 to prevent removal of the bill validator 12 when the shutter 22 is in the closed position and to permit removal of the bill validator 12 when the shutter 22 is in the opened position. The movement of the shutter 22 from the closed position to the opened position may result in a flange 50 of the shutter 22 being moved against the unlocked swing bolt 46 such that the swing bolt 46 retracts into an interior of the shutter lock 44. The swing bolt 46 may be spring-loaded or internally biased to resist the movement such that an external force may be required to actuate the shutter 22 against the force of the swing bolt 46.

A lever 52 may be attached to the shutter 22 to facilitate manually actuating the shutter 22 against the swing bolt 46 from the closed position to the opened position. The door 24 may include a channel 54 shaped to permit movement of the lever 52 with external manual manipulation while the door 24 is in the closed position. The lever 52 may be comprised of a threaded component 56 and a threaded knob 58 where the threaded component 56 is threadably secured at one end to the shutter 22 and at another end to the knob 58. The present invention is not particularly limited to the illustrated configuration of the lever 52 and fully contemplates the use of other types of levers 52 or other devices sufficient to actuate the shutter 22, including electro-mechanically driven devices optionally with an ability to automatically actuate the shutter 22. A guide 60 affixed to the door 24 may be inwardly offset from the shutter 22 to slidably mount the shutter 22 relative to the door 24 in a manner that permits the described movement between the opened position and a closed position. A pair of fasteners 62, 64 may be included to fasten the guide 60 to the door 24 and relative to a corresponding pair of channels 66, 68 included in the shutter 22. The fasteners 62, 64 may cooperate with the guide 60 to restrain movement of the shutter 22 and to maintain desirable position of the shutter 22 during movement between the opened and closed positions.

The positioning of the shutter 22 relative to the guide 60 may be coordinated with a ledge 70 affixed to an interior side of the door 24. The ledge 70 may extend inwardly from the door 24 to restrict access to the storage cassettes 16, 18 while the shutter 22 is in the opened position. The ledge 70 may include a first aperture 74 and a second aperture 76 through which a corresponding one of a first portion 78 and a second portion 80 of the shutter 22 extend. The first and second portions 78, 80 may be positioned at a first distance above the ledge 70 when in the closed position and above, at or below the ledge when in the opened position (shown as level). The ledge 70 may be positioned on the door 24 below the horizontal plane associated with the lowest removable component of the bill validator 12 by an amount sufficient to permit the shutter 22 to move downwardly a distance sufficient to permit positioning the upper portion 34 of the shutter 22 below the horizontal plane. Depending on the particular configuration of the bill validator 12 and/or the storage container 14, the ledge 70 may be farther below the horizontal plane than the upper portion 34 of the shutter 22 when in the opened position. Optionally, rather than the upper portion 34 of the shutter 22 being slightly above the ledge 70 when in the opened position, the shutter may be configured to lie flush with or slightly below the ledge 70.

The ledge 70 may extend sufficiently inwardly from the door 24 to render the shutter lock 44 inaccessible while the door 24 is in the closed position, regardless of whether the shutter 22 is in the closed door opened position. The ledge 70 may include downwardly extending lateral 84, 86 sides to further protect the shutter lock 44 from manipulation while the door 24 is in the closed position. The shutter lock 44 is described with respect to being electronically operable in order to highlight one capability of the present invention to facilitate locking and unlocking the shutter 22 to permit removal of the bill validator 12 for servicing without having to provide manual access to the shutter lock 44, e.g., without requiring a key or other implement that would necessitate the shutter lock 44 or a related locking mechanism to be accessible from an exterior of the door 24. The shutter lock 44 may be hidden behind the door 24 such that it is incapable of being manually actuated when the door 24 is closed without drilling through the door 24, i.e., the shutter lock 44 is not exposed to an exterior side of the door 24 to provide enhanced security. In the event the shutter lock 44 includes a manual override or a secondary manual lock, such a device may be positioned behind the door 24 and protected with the ledge 70, optionally requiring the door 24 to be opened in order to engage the manual override.

The present invention is not necessary limited to the shutter lock 44 being an electronically operable lock fully and contemplates the use of a manual lock. In the event a manual lock, such as but not necessarily limited to a key lock or a combination lock, were instead to be used, the door 24 may include an opening or access through which the manual lock may be manipulated from an exterior side of the door 24. The use of such a manual lock, however, maybe less advantageous as it may require the service technician tasked with servicing the bill validator to retain different keys and/or combinations for each safe being serviced, which can be cumbersome, and/or it may allow the use of a master key or common combination, which can jeopardize security of other safes should the master key or common combination is misappropriated. The electronically operable shutter lock 44 may be preferable at least insofar as potentially being less susceptible to security concerns attendant to manually actuated locks and/or its electronic nature may allow an electronic override sufficient to prevent undesirable unlocking operations, i.e., unlocking by unauthorized users in possession of misappropriated keys and/or combinations.

Depending on the particular configuration of the electronically operable shutter lock 44, it may be desirable to position the shutter flange 50 above or otherwise away from the swing bolt 46 when the shutter 22 is in the closed position. A slight gap 90 may be desirable between the flange 50 and the swing bolt 46 in order to position the shutter 22 in a no-load position, which may be beneficial in preventing binding of the swing bolt 46 resulting from continuous force being applied by the weight of the shutter 22. A biasing member 92 may be configured to bias the shutter 22 to the no-load position away from the bolt 46 when the shutter 22 is in the closed position and the shutter lock 44 is in the locked position. The biasing member 92 may include a threaded body having a spring-load bearing operable for receipt within a first recess 94 of the door 24. The bearing may be aligned with the first recess 94 with manual lifting of the lever 52 such that the bearing retains the shutter 22 in a non-loading position. The spring force on the bearing may be selected to permit disengagement of the bearing when the lever 52 is manually actuated in a downward direction toward the opened position or the shutter 22 is otherwise actuated toward the opened position subsequent to the shutter lock 44 being unlocked.

The door 24 may include a second recess 96 to receive the biasing member 92 when the shutter 22 is properly actuated to the opened position. The second recess 96 may operate similarly to the first recess 94 at least in so far as being sufficient to retain the shutter 22 in the opened position until the lever 52 is manually lifted upwardly toward the closed position or the shutter 22 is otherwise actuated upwardly, e.g., with an electrically driven motor. The second recess 96 may sufficiently to lodge the biasing member 92 against a force imparted by the swing bolt 46 that tends to push the shutter upwardly out of the closed position. Optionally, the first and second recesses 94, 96 may be unnecessary depending on the configuration of the shutter lock 44 and its tendency to operate more reliable with the shutter 22 being secured in a no-load position and/or whether it is capable of applying enough force to move the shutter 22 upwardly from the opened position. The biasing member 92 is shown to include a spring-loaded bearing for exemplary non-limiting purposes as the present invention fully contemplates the use of other biasing members or devices sufficient to facilitate positioning the shutter relative to the shutter lock.

A door lock 100 may be included to lock the door 24 to the housing independently of the shutter lock 44. Like the shutter lock 44, the door lock 100 may be an electronically operable lock operable between a locked state and an unlocked state in response to messages and/or electronic signal. The door lock 100 is shown to include two bars 102, 104 that extend into a wall of the housing 28 when in the locked state to lock the door 24 in the closed position and that retract when in the unlocked state to permit opening of the door 24. The door lock 100 may be separately controllable from the shutter lock 44 such that individuals having capabilities may to open the shutter 22 may not necessarily have capabilities to open the door 24. A human-machine interface (HMI), touch-screen or other interface 108 (see FIG. 1) may be included to facilitate electronically controlling the shutter lock 44 and/or the door lock 100, such as through user inputs thereto. A card reader 110 may also be included to read a secure card or magnetic strip configured to facilitate input of a code or other identifier needed to control one or both of the locks. The HMI 108 and/or card reader 110 may be housed below a top side of the housing 28 within a cavity 112. A pull-out tray 114 may be extended to position the HMI 108 and/or card reader 110 outboard of the housing 28.

The HMI 108 may include a network interface (not shown) sufficient to facilitate remote control and networking of the apparatus 10 and the housing 28 may be enclosed in a sleeve (not shown), such as in the manner described in U.S. patent application Ser. No. 13/648,503, the disclosure of which is hereby incorporated by reference in its entirety. A switch 120 may be included to facilitate electronically controlling the shutter lock 44. The switch 120 may be a magnetic switch operable to indicate whether the shutter 22 is in one of the closed position and the opened position depending on whether a first magnet 122 mounted to the shutter 22 is aligned with a second magnet 124 mounted to the door 24. The magnetic switch 120 may be configured to facilitate closing a circuit to indicate the shutter 22 being in the opened position when the first magnet 122 aligns with the second magnet 124 and to facilitate breaking the circuit to indicate the shutter 22 being in the closed position when the first magnet 122 is misaligned with the second magnet 124. While not shown, wires may extend from the shutter lock 44, the door lock 100 and/or the switch 120 to facilitate electronic communications therewith and/or these components may include wireless communication capabilities.

The apparatus 10 is shown to include three levels joined together within a plurality of fasteners. A bottom one of the three levels is shown to include an addition storage area having an opening 126 through which deposits may be made inserted for non-processed storage. The bottom level may include a combination lock 128 to control access to the items stored therein. While the apparatus 10 is shown to include three levels and a slidable HMI 108, the present invention fully contemplates of configurations and structures for the apparatus 10. In particular, the present invention contemplates the shutter 22 configuration to be suitable for use with vending machines, gaming machines, money exchanges and other types of devices that may rely upon a bill validator, sorter or there electro and/or mechanical device susceptible to periodic servicing to facilitate processing deposits for secure storage.

As noted above, the present invention is predominately described with respect to use of a sorter configured to process and deliver paper currency to one or more cassettes for safekeeping. This exemplary description is provided without intending to limit the scope and contemplation of the present invention as the present invention fully contemplates the apparatus being configured as a filing system, a shelving unit or other type of device having less secure locks or less robust construction such that the apparatus would not be considered as a safe or other highly secure device. Additionally, while the bill validator shown to include two heads and the storage area is shown to include a corresponding number of storage cassettes, the present invention fully contemplates the use of any number of validator heads and/or other configurations of the bill validator and the use of more or less storage cassettes or other types of storage devices suitable to facilitate safekeeping and subsequent portability of paper currency or other items stored therein.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A safe comprising:

a housing shaped to include a first opening and a second opening;

a bill validator positioned behind the first opening;

a cassette positioned behind the second opening;

a lockable door positioned within the second opening, the door being operable between at least a locked position and an unlocked position, the door preventing removal of the cassette when the door is in the locked position, the door permitting removal of the cassette when in the unlocked position; and a lockable shutter mounted to the door, the shutter being operable between at least a closed position and an opened position, the shutter at least partially covering the first opening when in the closed position to prevent removal of the bill validator, the shutter at least partially uncovering the first opening when in the opened position to permit removal of the bill validator;

wherein the first opening is shaped to be larger than the bill validator such that the bill validator is removable therethrough;

the door is shaped to cover the second opening, including being shaped to:

i.) permit removal of the bill validator through the first opening when the shutter is in the opened position and the door is in the locked position; and ii.) prevent removal of the bill validator through the first opening when the shutter is in the closed position and the door is in the locked position due to the shutter at least partially covering the first opening.

2. The safe of claim 1 further comprising a first lock mounted to the door and a second lock mounted to the door, the first lock being operable to lock the door to the housing when the door is in the locked position, the second lock being operable between a first position and a second position, the first position blocking the shutter from moving from the closed position to the opened position, the second position freeing the shutter to move from the closed position to the opened position.

3. The safe of claim 2 wherein the second lock is inaccessible while the door is in the locked position.

4. The safe of claim 2 wherein the second lock is below a ledge of the door such that the second lock inaccessible to manual actuation from the first position to the second position while the door is in the locked position.

5. The safe of claim 2 wherein the second lock is electronically operable between the first position and the second position while the door is in the locked position and wherein the second lock being incapable of being manually unlocked while the door is in the locked position.

6. The safe of claim 1 wherein the shutter extends above an upper most surface of the door when the shutter is in the closed position and wherein the shutter retracts below the upper most surface of the door when the shutter is in the opened position, wherein the shutter remains parallel with the door while moving between the opened and closed positions when the door is in the unlocked position and wherein the shutter remains parallel with the door while moving between the opened and closed positions when the door is in the locked position.

7. The safe of claim 1 further comprising a ledge attached to the door, the ledge shaped to extend inwardly from the door, the ledge shaped to extend sufficiently inwardly from the door into the housing so as to be between the bill validator and the cassette when the door is in the locked position, wherein the ledge includes at least one aperture, the shutter sliding within the at least one aperture when moving between the opened and closed positions, the shutter extending a first distance above the ledge when in the closed position and being approximately level with or below the ledge when in the opened position.

8. A safe comprising:

a housing shaped to include a first opening and a second opening;

a bill validator positioned behind the first opening;

a cassette positioned behind the second opening;

a lockable door positioned within the second opening, the door being operable between at least a locked position and an unlocked position, the door preventing removal of the cassette when the door is in the locked position, the door permitting removal of the cassette when in the unlocked position; and a lockable shutter mounted to the door, the shutter being operable between at least a closed position and an opened position, the shutter at least partially covering the first opening when in the closed position to prevent removal of the bill validator, the shutter at least partially uncovering the first opening when in the opened position to permit removal of the bill validator;

a first lock mounted to the door and a second lock mounted to the door, the first lock being operable to lock the door to the housing when the door is in the locked position, the second lock being operable between a first position and a second position, the first position blocking the shutter from moving from the closed position to the opened position, the second position freeing the shutter to move from the closed position to the opened position;

a biasing member mounted to the shutter and operable with a first detent included on the door, the biasing member operable with the first detent to retain the shutter above the second lock when the shutter is in the closed position; and wherein the second lock includes a swing bolt, wherein the first detent is operable with the biasing member to retain the shutter above the swing bolt when the shutter is in the closed position, and wherein the biasing member is further operable with a second detent included on the door to retain the shutter in the opened position against a force exerted by the swing bolt against the shutter when the shutter is in the closed position, the force tending to push the shutter from the closed position to the opened position.

9. A safe comprising:

a housing shaped to include a first opening and a second opening;

a bill validator positioned behind the first opening;

a cassette positioned behind the second opening;

a lockable door positioned within the second opening, the door being operable between at least a locked position and an unlocked position, the door preventing removal of the cassette when the door is in the locked position, the door permitting removal of the cassette when in the unlocked position; and a lockable shutter mounted to the door, the shutter being operable between at least a closed position and an opened position, the shutter at least partially covering the first opening when in the closed position to prevent removal of the bill validator, the shutter at least partially uncovering the first opening when in the opened position to permit removal of the bill validator; and a magnetic switch operable to indicate whether the shutter is in one of the closed position and the opened position, the magnetic switch including a first magnet mounted to the shutter and a second magnet mounted to the door, the magnetic switch closing a circuit to indicate the shutter being in one of the opened position and the closed position when the first magnet aligns with the second magnet, the magnetic switch breaking the circuit to indicate the shutter being in the other one of the opened position and the closed position when the first magnet is misaligned with the second magnet.

10. An apparatus comprising:

a substantially enclosed housing shaped to include a first opening and a second opening;

a storage container positioned behind the second opening;

a sorter positioned behind the first opening, the sorter configured to deliver deposits to the storage container;

a door positioned relative to the second opening, the door being operable between at least a closed position and an opened position, the door preventing removal of the container through the second opening when in the closed position, the door permitting removal of the container through the second opening when in the opened position, the door permitting removal of the sorter through the first opening when the door is in the opened position;

a shutter affixed to the door, the shutter being operable between at least a closed position and an opened position, the shutter preventing removal of the sorter through the first opening when in the closed position and the door is in the closed position, the shutter permitting removal of the sorter through the first opening when in the opened position and the door is in the closed position.

11. The apparatus of claim 10 further comprising a door lock affixed to the door and a shutter lock affixed to the door, the door lock locking the door to the housing, the shutter lock being operable between an unlocked position and a locked position, the locked position preventing movement of the shutter from the closed position to the opened position, the unlocked position permitting movement of the shutter from the closed position to the opened position.

12. The apparatus of claim 11 further comprising:

a biasing member and wherein the shutter lock includes a bolt, the biasing member configured to bias the shutter to a no-load position away from the bolt when the shutter is in the closed position and the shutter lock is in the locked position; and wherein the biasing member is further configured to retain the shutter in the opened position against an applied force of the bolt, thereby preventing the bolt from actuating the shutter from the opened position to the closed position.

13. The apparatus of claim 12 wherein the biasing member is a spring-loaded bearing affixed to the shutter and configured to lodge within a first recess of the door when the shutter is in the closed position and to lodge within a second recess of the door when the shutter is in the opened position.

14. The apparatus of claim 11 wherein the shutter lock is inaccessible when the door is in the closed position and the opened position.

15. The apparatus of claim 11 wherein the shutter is manually movable when the shutter lock is in the unlocked position between the opened and closed positions with a knob accessible from outside of the door when the door is in the closed position.

16. A safe comprising a secure storage area;

a sorter configured to deliver deposits to the secure storage area;

a door configured to prevent access to the secure storage area when locked in a closed position and to permit access to the secure storage area and the sorter when in an opened position;

a door lock operable to lock the door in the closed position;

a shutter mounted to the door and configured to prevent removal of the sorter when locked in a closed position while the door is locked in the closed position and to permit removal of the sorter when in an opened position while the door is locked in the closed position; and a shutter lock operable to lock the shutter in the closed position.

17. The safe of claim 16 wherein the shutter lock is mounted to the door in an inaccessible position sufficient to prevent manual manipulation of the lock whenever the door is locked in the closed position, the shutter being mounted to the door such that the shutter remains parallel to the door when moving between the opened and closed positions.

18. The apparatus of claim 10 wherein:

the first opening is substantially above the second opening and shaped to permit the removal of the sorter therethrough;

the door is shaped to cover substantially all over the second opening and none of the first opening; and the shutter is shaped to:

i) cover a sufficient portion of the first opening when in the closed position to prevent removal of the sorter therethrough while the door is in the closed position; and ii) uncover a sufficient portion of the first opening when in the opened position to permit removal of the sorter therethrough while the door is in the closed position.

19. The safe of claim 16 wherein while the door is in the closed position:

the door is shaped to cover substantially all of the secure storage area and none of the sorter; and the shutter is shaped to cover at least some of the sorter when in the closed position and none of the sorter when in the opened position.

* * * * *